US006477821B1

(12) United States Patent
Bois

(10) Patent No.: US 6,477,821 B1
(45) Date of Patent: Nov. 12, 2002

(54) METHOD FOR PRODUCING BAGS COMPRISING CLOSURE PROFILES ACTUATED BY A SLIDER

(75) Inventor: Henri Georges Bois, Neuilly-sur-Seine (FR)

(73) Assignee: Flexico-France, Henonville (FR)

( * ) Notice: Subject to any disclaimer, the term of this patent is extended or adjusted under 35 U.S.C. 154(b) by 0 days.

(21) Appl. No.: 09/446,911

(22) PCT Filed: May 4, 1999

(86) PCT No.: PCT/FR99/01053

§ 371 (c)(1),
(2), (4) Date: Jan. 4, 2000

(87) PCT Pub. No.: WO99/56947

PCT Pub. Date: Nov. 11, 1999

(30) Foreign Application Priority Data

May 5, 1998 (FR) ..... 98 05681

(51) Int. Cl.[7] ..... B65B 61/18

(52) U.S. Cl. ..... 53/412; 53/450; 53/452; 53/455; 493/210; 493/212; 493/213; 493/927

(58) Field of Search ..... 53/412, 133.3, 53/133.4, 133.8, 452, 455, 477, 545, 550, 551, 552, 450; 383/61, 63, 64, 65; 493/927, 210, 212, 213

(56) References Cited

U.S. PATENT DOCUMENTS

| | | | | | |
|---|---|---|---|---|---|
| 3,181,583 | A | | 5/1965 | Lingenfelter | 150/3 |
| 4,534,752 | A | | 8/1985 | Ferrell et al. | 493/213 |
| 4,617,683 | A | | 10/1986 | Christoff | 383/63 |
| 4,807,300 | A | * | 2/1989 | Ausnit et al. | 383/65 |
| 4,892,414 | A | | 1/1990 | Ausnit | 383/63 |
| 4,894,975 | A | | 1/1990 | Ausnit | 53/412 |
| 4,909,017 | A | | 3/1990 | McMahon et al. | 53/410 |
| 4,925,316 | A | * | 5/1990 | Van Erden et al. | 383/63 |
| 5,111,643 | A | | 5/1992 | Hobock | 53/551 |
| 5,211,482 | A | | 5/1993 | Tilman | 383/202 |
| 5,382,094 | A | | 1/1995 | Ausnit | 383/65 |
| 5,400,565 | A | | 3/1995 | Terminella et al. | 53/133.4 |
| 5,669,715 | A | * | 9/1997 | Dobreski et al. | 383/64 |
| 5,911,508 | A | * | 6/1999 | Dobreski et al. | 383/64 |
| 5,956,924 | A | * | 9/1999 | Thieman | 53/412 |
| 5,964,532 | A | * | 10/1999 | St. Phillips et al. | 383/64 |
| 6,000,197 | A | * | 12/1999 | Ausnit | 53/412 |
| 6,257,763 | B1 | * | 7/2001 | Stolmeier et al. | 383/64 |

FOREIGN PATENT DOCUMENTS

| | | |
|---|---|---|
| EP | 0 051 010 | 5/1982 |
| EP | 0 102 301 | 3/1984 |
| EP | 0 395 362 | 10/1990 |
| EP | 0 479 661 | 4/1992 |
| EP | 0 562 774 | 9/1993 |
| EP | 0 728 665 | 8/1996 |

* cited by examiner

*Primary Examiner*—Stephen F. Gerrity
*Assistant Examiner*—Louis Huynh
(74) *Attorney, Agent, or Firm*—Jacobson Holman PLLC

(57) ABSTRACT

A method for automatically making bags equipped with matching closure profiles comprising the steps of: unwinding a supply of at least a film for forming the bag walls; unwinding a supply of closure assembly comprising a W-shaped support sheet, constituting an inner U-shaped tear band provided on its inner surface opposite respectively the matching closure profiles, and the external lateral webs extending beyond the closure profiles and the U-shaped inner band, the closure assembly being further pre-equipped with a series of sliders actuating the closure profiles distributed over the length of the unwinding closure assembly; and fixing the resulting closure assembly via the external lateral webs on the film forming the bag walls.

29 Claims, 2 Drawing Sheets

METHOD FOR PRODUCING BAGS COMPRISING CLOSURE PROFILES ACTUATED BY A SLIDER

FIELD OF THE INVENTION

The present invention relates to the field of bags having complementary closure strips designed to enable a user to perform a series of successive opening and closing operations.

Numerous types of bag and/or closure strip have already been proposed for this purpose.

By way of non-limiting example, reference can be made to the following documents: U.S. Pat. No. 4,929,255, U.S. Pat. No. 4,892,414, EP-0 562 774, EP-0 395 362, U.S. Pat. Nos. 5,382,094, 5,181,583, EP-0 728 665.

More precisely still, the present invention relates to the field of bags in which the closure strips are opened and closed by means of a slider.

Various types of bag and slider-operated closure strip have also been proposed.

By way of example, reference can be made on this point to the following documents: EP-0 051 010, EP-0 102 301, and EP-0 479 661.

BACKGROUND OF THE INVENTION

Bags having slider-actuated closure strips offer the huge advantage, compared with bags that do not have a slider, of being easy to handle.

The slider makes it easier to separate the strips in order to open such bags, and conversely makes it easier to engage the strips in order to close such a bag. All that needs to be done for this purpose is to move the slider in translation along the strips.

Attempts have indeed been made to facilitate the handling of strips that do not have a slider, in particular by providing ribs on the walls of bags fitted in this way, the ribs making it easier to locate the strips by touch. Nevertheless, those dispositions do not give full satisfaction compared with slider-fitted bags. Firstly, making such ribs complicates the production installation. Secondly, such ribs do not provide location and actuation that are as easy as those provided by a slider.

However, in practice, it is observed nowadays that bags fitted with slider-actuated closure strips have not been the subject of major industrial development.

This seems to be due in particular to the fact that it is difficult to make use of slider-actuated closure strips on conventional machines for forming and/or filling bags automatically. Sliders gives rise to extra thickness which makes it very difficult for automatic machines to move strips and/or films fitted therewith.

As described in documents EP-0 051 010, EP-0 102 301, and EP-0 479 661, that is why proposals in the past have been made to add sliders to the strips after the closure strips have themselves been fixed on the film(s) making up a bag. However, those proposals generally require equipment that is rather complex for delivering the sliders, opening them, and then closing them on the closure strips, with the slider being accurately positioned relative to the closure strip, and as a general rule doing so on a continuous traveling line.

SUMMARY OF THE INVENTION

An object of the present invention is now to propose novel means for automatically making bags that include slider-actuated opening and/or sealing strips.

According to the present invention, this object is achieved by an automatic method of manufacturing bags that is characterized by the fact that it comprises the steps consisting in:

- supplying at least one moving film adapted to form bag walls;
- supplying at least one moving closure assembly comprising a W-shaped support sheet constituting both an internal channel-section tamperproofing tape provided on its facing internal surfaces with respective complementary closure strips, and also external lateral webs extending beyond the closure strips and the internal channel-section tape, the closure assembly also being prefitted with a series of sliders for actuating the closure strips and distributed along the length of the closure assembly as fed; and
- fixing the closure assembly formed in this way, via the external lateral support webs to the film forming the bag wall.

As explained below, the method of the present invention makes it possible to eliminate the drawbacks of the previously-known means.

Firstly, because of the internal channel-section tamperproofing tape, the present invention makes it possible to guarantee initial sealing of the bags and makes it possible to inspect and spot easily any untimely opening or attempted opening of such bags.

In addition, and above all, because of the presence of the lateral external support webs which project considerably beyond the sliders, the present invention makes it possible to locate the sliders away from the fixing zone (preferably implemented by heat-sealing jaws) for fixing the closure assembly on the film constituting the bag.

The present invention also makes it possible to deliver bags either in the open state or in the closed state depending on requirements.

The present invention also relates to a machine for automatically manufacturing bags by implementing the above-specified method, and bags obtained thereby and to the closure assembly for performing the method.

BRIEF DESCRIPTION OF THE DRAWINGS

Other characteristics, objects, and advantages of the present invention will appear on reading the following detailed description and from the accompanying drawings, in which.

DETAILED DESCRIPTION OF THE PREFERRED EMBODIMENTS

As mentioned above, the present invention relates to using an automatic machine to manufacture reclosable bags having slider-actuated closure strips.

The present invention can be applied to machines for automatically manufacturing bags equally well regardless of whether travel through the machines is horizontal or vertical.

In addition, the present invention applies equally well to machines for automatically manufacturing bags that are filled during a step subsequent to manufacture, and possibly geographically separated from the manufacturing site, and to machines for manufacturing, filling, and sealing bags at a single location and during successive steps.

Thus, the present invention applies preferably, but in non-limiting manner, to machines for automatically forming, filling, and sealing bags, and most advantageously to such machines where bags travel vertically.

A description of such machines for automatically forming, filling, and sealing bags that travel vertically can be found in the following documents: U.S. Pat. Nos. 4,894,975, 5,400,565, 5,111,643, 4,909,017, 4,617,683.

Figure 2:
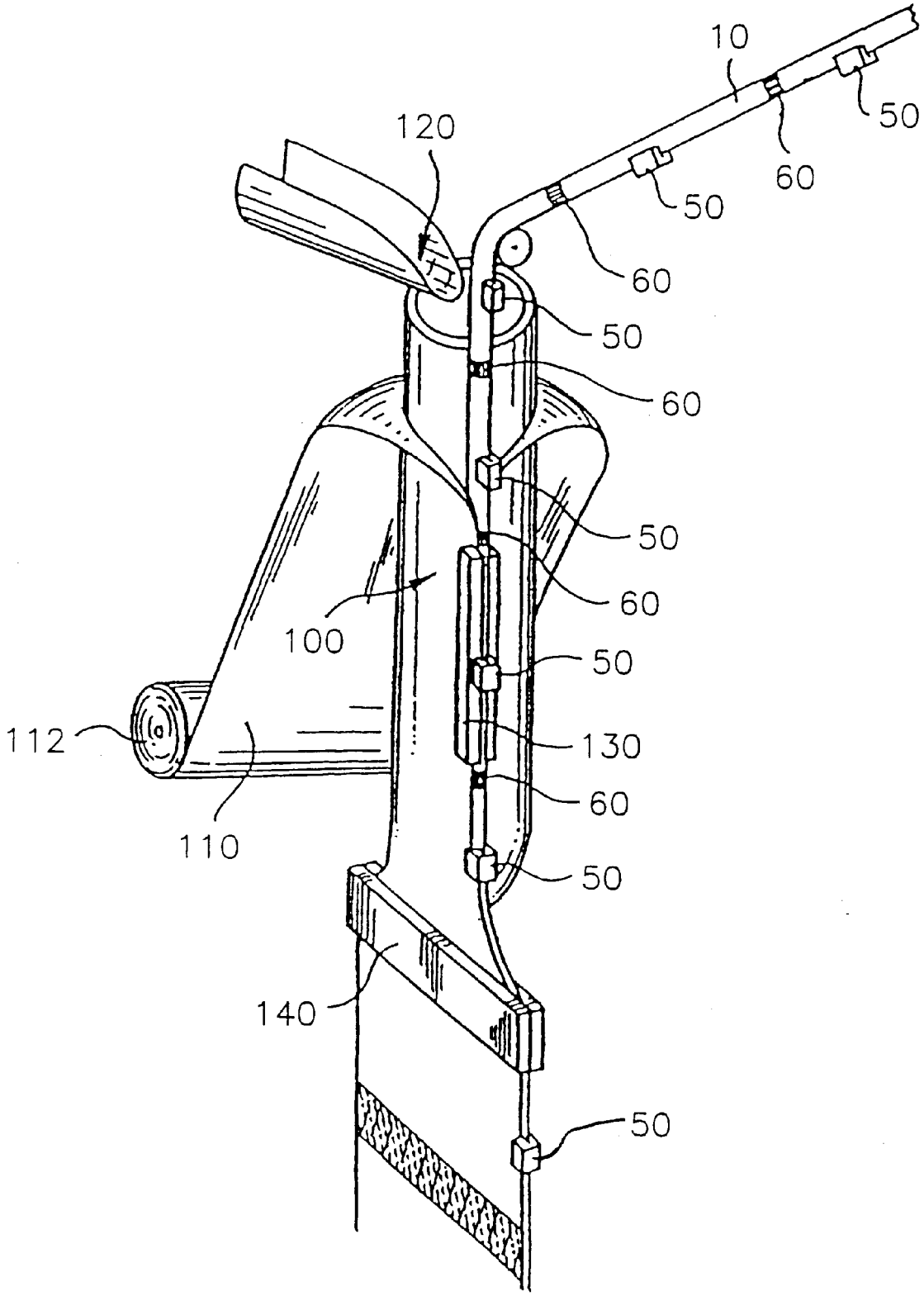
FIG. 2 shows an automatic machine for forming, filling, and sealing bags in accordance with the present invention.

Essentially, and as shown in accompanying FIG. 2, it is recalled that such machines generally comprise: a forming throat 100 which receives as input a film 110 in the flat state taken from an unreeler 112 and which delivers at its outlet the film 110 shaped into a tube; a filling chute 120 which opens out into the forming throat 100, and consequently into said tube; longitudinal heat-sealing means 130 for closing the tube longitudinally; and means 140 suitable for sequentially generating a first transverse line of heat-sealing before a product is introduced into the tube via the filler chute 120, and then a second line of transverse heat-sealing after the product has been introduced into the tube, thereby sealing a package around the product.

Figure 1:
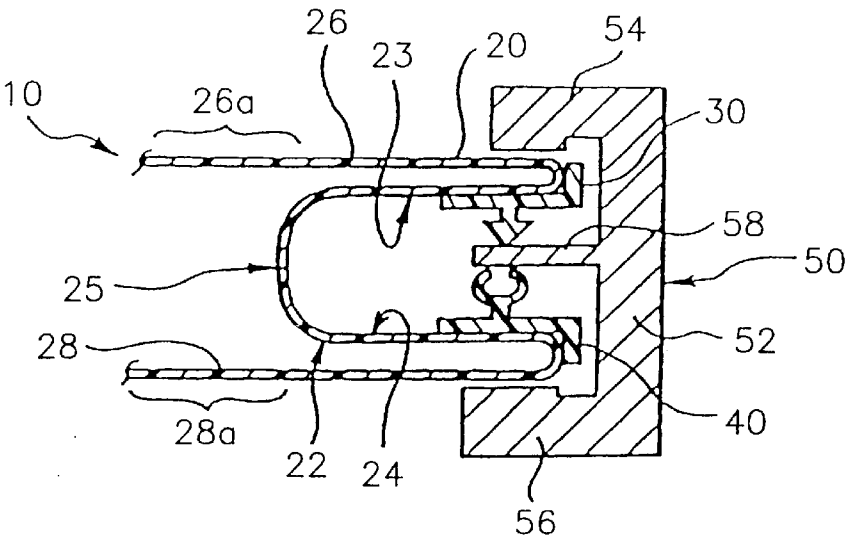
FIG. 1 is a diagrammatic section view of a closure assembly of the present invention.
Figure 3:
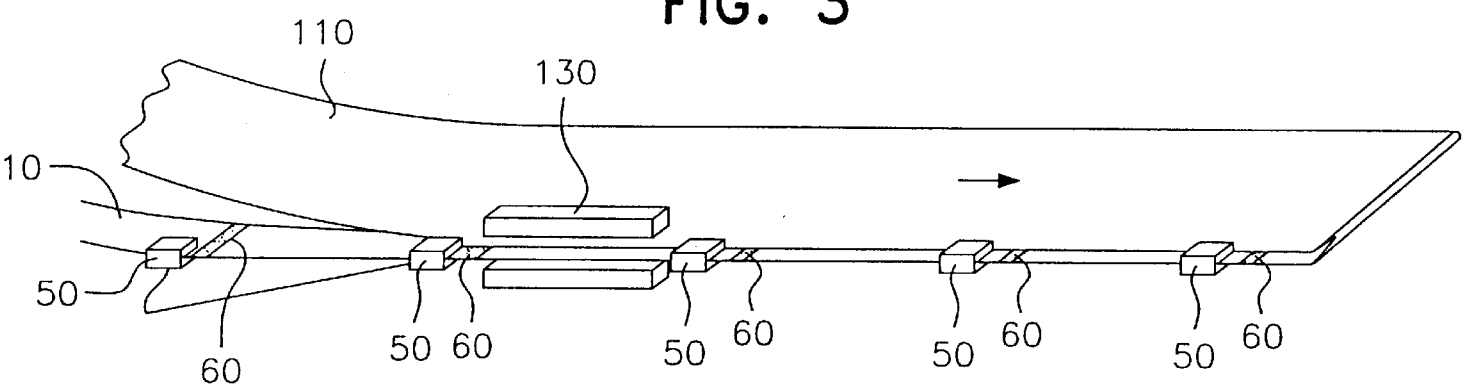
FIG. 3 shows an automatic machine in accordance with the present invention for making bags that travel horizontally as similarly shown in FIG. 2.

As mentioned above in the context of the present invention, the machine for automatically forming bags also receives a closure assembly 10 which comprises, as shown in FIG. 1, a W-shaped support sheet 20 constituting firstly an internal channel-section tamperproofing tape 22 provided on its facing inside surfaces 23 and 24 with respective complementary closure strips 30 and 40, and secondly external lateral webs 26 and 28 which extend beyond the closure strips 30 and 40 and the internal channel-section tape 22, the closure assembly 10 also being prefitted with one of a series of sliders 50 for actuating the closure strips 30 and 40, which sliders are distributed along the length of the closure assembly as delivered.

The closure strips 30 and 40 can be implemented in a wide variety of ways. They preferably comprise respective complementary male and female section members. The structure thereof is not described in greater detail below.

Similarly, the sliders 50 can be implemented in a wide variety of ways. Preferably, as shown in FIG. 1, each slider comprises a soleplate 52 which carriers two side flanges 54 and 56 on one of its faces together with a central separator rib 58 which co-operates with the side flanges 54 and 56 to define two passages which converge or diverge (depending on the direction considered) for receiving respective ones of the strips 30 and 40. The structure of sliders suitable for use in the context of the invention is not described in greater detail below.

The pitch at which sliders 50 are disposed on the closure assembly 10 is equal to the size of the bags that are to be formed.

As shown diagrammatically in FIG. 2, this closure assembly 10 is preferably fed longitudinally and is fixed (preferably by heat-sealing) via said external lateral webs 26 and 28 to the free edges of the film 110 that has been shaped into a tube.

Still more precisely, the external support webs 26 and 28 are most preferably heat-sealed to the film 110 via their free segments 26*a* and 28*a* situated beyond the central channel-section tape 22.

In addition, and preferably but in non-limiting manner, the external webs 26 and 28 are heat-sealed to the film 110 using the above-mentioned means 130 which perform longitudinal heat-sealing of the film.

The closure assembly 10 is cut to the size of a bag by conventional cutting means, preferably associated with the means for transverse heat-sealing 140, thereby separating bags individually.

Also and preferably, the closure strips 30 and 40 are mutually engaged (in the closed position) while they are being fixed to the film 110. This disposition guarantees that the closure assembly 10 is positioned properly and accurately on the film 110.

Nevertheless, the closure strips 30 and 40 can subsequently be separated by moving the sliders 50 by means of an appropriate tool, should that be necessary.

Where appropriate, it is also possible to provide lines of heat-sealing 60 at constant pitch to bond together the complementary closure strips 30 and 40 prior to feeding them to the machine for automatically forming bags. The pitch of these lines of heat-sealing 60 is equal to the size of the bags. Under such circumstances, the closure strips 30 and 40 are mutually engaged (closed) between the slider 50 and one of the lines of heat-sealing 60, and they are disengaged (opened) between the slider 50 and the other adjacent line of heat-sealing 60.

Nevertheless, such lines of heat-sealing 60 are not always essential. Naturally, implementations that avoid using such lines of heat-sealing present the advantage of avoiding any need for the position of the closure assembly to be identified relative to the film.

In a variant, a line of weakness or precut can be provided in the central channel-section tape 22, e.g. in a middle portion thereof. Such a precut line is represented diagrammatically by reference 25 in FIG. 1.

The sheet 20 supporting the strips, and the film 110 used in the context of the present invention, can be implemented in a wide variety of ways. It can be constituted merely by a single film of thermoplastic material, or by a composite film of thermoplastic material, i.e. a film built up by juxtaposing layers of different kinds, or indeed a composite film, e.g. constituted by plastic-coated paper or by a metal-coated film.

Naturally, the present invention is not limited to the particular embodiments described above, but extends to any variant within the spirit of the invention.

In the description above, the closure assembly 10 is fed longitudinally, i.e. the closure assembly 10 is fed in the same direction as the film 110. However, in a variant, it is possible to envisage feeding the closure assembly 10 in a direction which extends transversely to the travel direction of the film 110. The person skilled in the art is aware of numerous machines that operate by feeding closure strips transversely. That is why this disposition is not described in greater detail below. When closure strips are fed transversely to the travel direction of the film 110, it is possible either to feed the closure assembly in the form of an individual segment precut to the size of a bag, or else in the form of a continuous strip which is cut in situ to the size of a bag. In another variant which is particularly suitable to making bags with travel taking place horizontally, the bags are made from two films respectively constituting the two main walls of a bag.

In yet another variant, it is possible to envisage fixing the closure assembly 10 to the film 110 by means other than the longitudinal jaws 130.

The complementary closure strips 30 and 40 can be fitted, e.g. by means of adhesive or heat-sealing, to the support sheet 20, or they can be integrally formed with the support sheet 20, e.g. by molding.

In a non-limiting embodiment, the width of the external lateral webs 26 and 28 can be about 25 mm to 40 mm. In addition, in a variant, the external lateral webs 26 and 28 can be heat-sealed over their entire width to the film of bags. In which case, the segments referenced 26*a* and 28*a* in FIG. 1 coincide with the webs 26 and 28.

What is claimed is:

1. A method of automatically manufacturing bags fitted with complementary closure strips, the method comprising the steps:

supplying at least one film adapted to form bag walls;

supplying at least one closure assembly comprising a W-shaped support sheet constituting both an internal channel-section tamperproofing tape provided on facing internal surfaces with respective complementary closure strips, and also external lateral webs extending beyond the closure strips and the internal channel-section tape, the closure assembly also being prefitted with a series of sliders for actuating the closure strips and distributed along the length of the closure assembly as fed; and fixing the closure assembly via the external lateral webs to the film forming the bag wall.

2. A method according to claim 1, wherein the method is implemented on an automatic machine for making bags that travel horizontally.

3. A method according to claim 1, wherein the method is implemented on an automatic machine for making bags that travel vertically.

4. A method according to claim 1, wherein the method is implemented on an automatic machine for forming, filling, and sealing bags.

5. A method according to claim 1, wherein a pitch of the sliders on the closure assembly is equal to a size of the bags to be formed.

6. A method according to claim 1, wherein the closure assembly is fed parallel to the travel direction of the film.

7. A method according to claim 1, wherein the closure assembly is fed perpendicularly to the travel direction of the film.

8. A method according to claim 1, wherein the closure strips are mutually engaged in a closed position while being fixed to the film.

9. A method of automatically manufacturing bags fitted with complementary closure strips, the method comprising the steps:

supplying at least one film adapted to form bag walls;

supplying at least one closure assembly comprising a W-shaped support sheet constituting both an internal channel-section tamperproofing tape provided on facing internal surfaces with respective complementary closure strips, and also external lateral webs extending beyond the closure strips and the internal channel-section tape, the closure assembly also being prefitted with a series of sliders for actuating the closure strips and distributed along the length of the closure assembly as fed; and fixing the closure assembly via the external lateral webs to the film forming the bag wall, the closure assembly having lines of heat-sealing at constant pitch for bonding together the complementary closure strips prior to the assembly being fed to the machine for automatically forming bags.

10. A method according to claim 9, wherein the pitch of the lines of heat-sealing is equal to a size of the bags.

11. A method according to claim 9, wherein the closure strips are mutually engaged in a closed position between the slider and one of the lines of heat-sealing, and are disengaged in an open position between the slider and the adjacent other line of heat-sealing.

12. A method according to claim 9, wherein the method is implemented on an automatic machine for making bags that travel horizontally.

13. A method according to claim 9, wherein the method is implemented on an automatic machine for making bags that travel vertically.

14. A method according to claim 9, wherein the method is implemented on an automatic machine for forming, filling, and sealing bags.

15. A method according to claim 9, wherein a pitch of the sliders on the closure assembly is equal to a size of the bags to be formed.

16. A method according to claim 9, wherein the closure assembly is fed parallel to the travel direction of the film.

17. A method according to claim 9, wherein the closure assembly is fed perpendicularly to the travel direction of the film.

18. A method according to claim 9, wherein the closure strips are mutually engaged in a closed position while being fixed to the film.

19. A method of automatically manufacturing bags fitted with complementary closure strips, the method comprising the steps:

supplying at least one film adapted to form bag walls and displacing said film along a longitudinal axis;

supplying at least one closure assembly comprising a W-shaped support sheet constituting both an internal channel-section tamperproofing tape provided on facing internal surfaces with respective complementary closure strips, and also external lateral webs extending beyond the closure strips and the internal channel-section tape and displacing said closure assembly in contact with said film, the closure assembly also being prefitted with a aeries of sliders for actuating the closure strips and distributed along the length of the closure assembly as fed; and fixing the closure assembly via the external lateral webs to the film forming the bag wall.

20. A method according to claim 19, wherein the method is implemented on an automatic machine for making bags that travel horizontally.

21. A method according to claim 19, wherein the method is implemented on an automatic machine for making bags that travel vertically.

22. A method according to claim 19, wherein the method is implemented on an automatic machine for forming, filling, and sealing bags.

23. A method according to claim 19, wherein a pitch of the sliders on the closure assembly is equal to a size of the bags to be formed.

24. A method according to claim 19, wherein the closure assembly is fed parallel to the travel direction of the film.

25. A method according to claim 19, wherein the closure assembly is fed perpendicularly to the travel direction of the film.

26. A method according to claim 19, wherein the closure strips are mutually engaged in a closed position while being fixed to the film.

27. A method according to claim 19, wherein the closure assembly has lines of heat-sealing at constant pitch for bonding together the complementary closure strips prior to the assembly being fed to the machine for automatically forming bags.

28. A method according to claim 27, wherein the pitch of the lines of heat-sealing is equal to a size of the bags.

29. A method according to claim 27, wherein the closure strips are mutually enaged in a closed position between the slider and one of the lines of heat-sealing, and are disengaged in an open position between the slider and the adjacent other line of heat-sealing.

* * * * *